US006205603B1

(12) United States Patent
Vande Haar

(10) Patent No.: US 6,205,603 B1
(45) Date of Patent: Mar. 27, 2001

(54) FRONT WATER INJECTION FOR FRONT LOADING WASHING MACHINE

(75) Inventor: Evan R. Vande Haar, Pella, IA (US)

(73) Assignee: Maytag Corporation, Newton, IA (US)

( * ) Notice: Under 35 U.S.C. 154(b), the term of this patent shall be extended for 0 days.

(21) Appl. No.: 08/994,679

(22) Filed: Dec. 19, 1997

(51) Int. Cl.[7] ..... D06F 37/22
(52) U.S. Cl. ..... 8/159; 68/23.2; 68/23.4
(58) Field of Search ..... 8/158, 159; 68/23.2, 68/23.4, 24, 58

(56) References Cited

U.S. PATENT DOCUMENTS

| | | | | |
|---|---|---|---|---|
| 2,296,267 | * | 9/1942 | Baird | 8/159 |
| 2,613,837 | | 10/1952 | Morton | 220/15 |
| 2,771,766 | | 11/1956 | Dunlap | 68/24 |
| 2,938,367 | | 5/1960 | Sulzmann | 68/58 |
| 2,966,052 | | 12/1960 | Syles | 68/58 |
| 3,256,720 | | 6/1966 | Green et al. | 68/12 |
| 3,663,975 | * | 5/1972 | Fish et al. | 8/158 |
| 3,811,300 | | 5/1974 | Barton et al. | 68/58 |
| 4,991,247 | * | 2/1991 | Casywell | 8/158 |
| 5,513,504 | * | 5/1996 | Sribar et al. | 68/23.2 |
| 5,548,979 | * | 8/1996 | Ryan et al. | 68/23.2 |
| 5,829,084 | * | 11/1998 | Fujiwara | 68/23.2 |

FOREIGN PATENT DOCUMENTS

| | | | | |
|---|---|---|---|---|
| 990528 | * | 6/1976 | (CA) | 68/23.2 |
| 52-5169 | * | 4/1977 | (JP) | 68/23.2 |
| 53-128163 | * | 11/1978 | (JP) | 68/23.2 |
| 54-100156 | * | 8/1979 | (JP) | 68/23.2 |
| 60-7517 | * | 2/1985 | (JP) | 68/23.2 |
| 61-59758 | * | 12/1986 | (JP) | 68/23.2 |

* cited by examiner

*Primary Examiner*—Frankie L. Stinson
(74) *Attorney, Agent, or Firm*—Zarley, McKee, Thomte, Voorhees & Sease

(57) ABSTRACT

An improved front loading washing machine and method of wetting clothes in a front loading machine is provided. The balance ring of the machine has a plurality of holes extending 360° around the ring through which water is flowable. A water supply line directs water to the space between the machine tub and spinner, such that the water flows by gravity along the outer surface of the balance ring and then drains or drips through the holes in the balance ring for introduction into the spinner, thereby wetting the clothes in the spinner. With this improved machine, the amount of time required to saturate the clothes in the spinner is minimized, thereby enhancing the washing action on the clothes.

10 Claims, 3 Drawing Sheets

FRONT WATER INJECTION FOR FRONT LOADING WASHING MACHINE

BACKGROUND OF THE INVENTION

Front loading washing machines are common in Europe and are becoming popular in the United States. With large loads in a front loading machines, a problem exists in that the clothes take a significant amount of time to become saturated with wash water. As the water fills the bottom of the tub and into the spinner, the clothes are moved through the water. However, especially with larger loads, some of the clothes remain dry for an undesirably long period of time. This detracts from the cleaning efficacy for those non-saturated clothes.

Prior art front loading machines have tried to alleviate this problem by injecting water through the baffles in the spinner. Since the spinner rotates, supplying water through the baffles requires complex, and thus costly construction of the baffle design. As an alternate, water has been injected through a hole in the door boot. A hole in the door boot is subject to leakage. Also, if the injector or spray nozzle extends into the spinner chamber, clothes in the spinner are subjected to excessive wear by contact with the injector or nozzle. The prior art has not provided a satisfactory solution to the clothes wetting problem.

Accordingly, a primary objective of the present invention is the provision of an improved front loading washing machine having front injection of water.

Another objective of the present invention is the provision of an improved method of wetting clothes in a front loading washing machine.

Still another objective of the present invention is the provision of a front loading washing machine wherein a portion of the wash water is supplied to the spinner through holes in the balance ring through which the water drains for wetting clothes in the spinner.

A further objective of the present invention is the provision of a front loading washing machine which reduces the amount of time required to saturate the clothes in the spinner with wash water.

Another objective of the present invention is a method of wetting clothes in a front loading washing machine in a minimal amount of time.

These and other objectives will become apparent from the following description of the invention.

SUMMARY OF THE INVENTION

An improved front loading washing machine is provided, and generally includes a cabinet, a tub mounted within the cabinet for holding water, and a spinner rotatably mounted in the tub. The tub and spinner each have a forward end with an access opening therein through which clothes are introduced into and removed from the spinner. A balance ring extends around the access opening adjacent the forward end of the spinner. The balance ring has a plurality of holes. A water supply line or injector directs water to a space between the spinner and tub adjacent the forward end of the spinner such that the water flows along an outer surface of the balance ring and then drains through the holes in the balance ring for introduction into the spinner, thereby wetting clothes in the spinner. The holes in the balance ring are provided at the juncture between the main body of the balance ring and a forwardly projecting lip. The water is supplied at a 12 o'clock position relative to the spinner and flows by gravity through the holes in the balance ring.

DETAILED DESCRIPTION OF THE DRAWINGS

Figure 1:
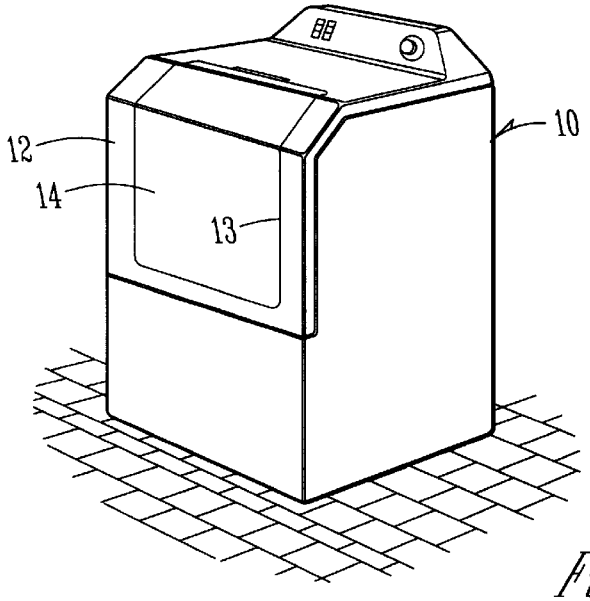
FIG. 1 is a perspective view of a front loading washing machine.

The improved front loading washing machine of the present invention generally includes a cabinet 10 having a front wall 12 with an access opening 13 therein. A door 14 is pivotally mounted to the cabinet 10 for movement between open and closed positions relative to the access opening 13.

A tub 16 is mounted within the cabinet and is adapted to hold water. The tub 16 includes a forward end 18 with an opening 20 aligned with the access opening 13 of the cabinet 10. A perforated spinner 22 is rotatably mounted within the tub 16. The spinner 22 includes an open forward end 24, a closed rearward end 26, and a side wall 28 which defines a chamber within the spinner 22 for holding clothes to be washed.

A circular balance ring 32 is mounted in the spinner 22 adjacent the forward end 24 thereof. The balance ring includes a hollow main body 34 having a plurality of compartments therein. A balancing fluid is sealed within the body 34 and is adapted to move between the compartments so as to balance uneven loads in the spinner 22. The body 34 of the balance ring 32 includes an inner surface 36 disposed towards the chamber 30 of the spinner 22 and an outer surface 38 disposed away from the chamber 30. A lip 40 extends forwardly from the main body 34 of the balance ring 32 and through the opening 20 of the tub.

The above construction of the front loading washing machine is conventional and does not constitute a part of the present invention.

The present invention is directed towards a method and means of supplying water into the chamber 30 of the spinner 22 so as to enhance wetting of the clothes in the spinner 22 in a minimal amount of time. More particularly, the balance ring 32 includes a plurality of holes 42 extending 360° around the ring adjacent the juncture between the main body 34 and the lip 40. Preferably, the holes are elongated slots, though other shaped holes will also function for purposes of the present invention.

Figure 3:
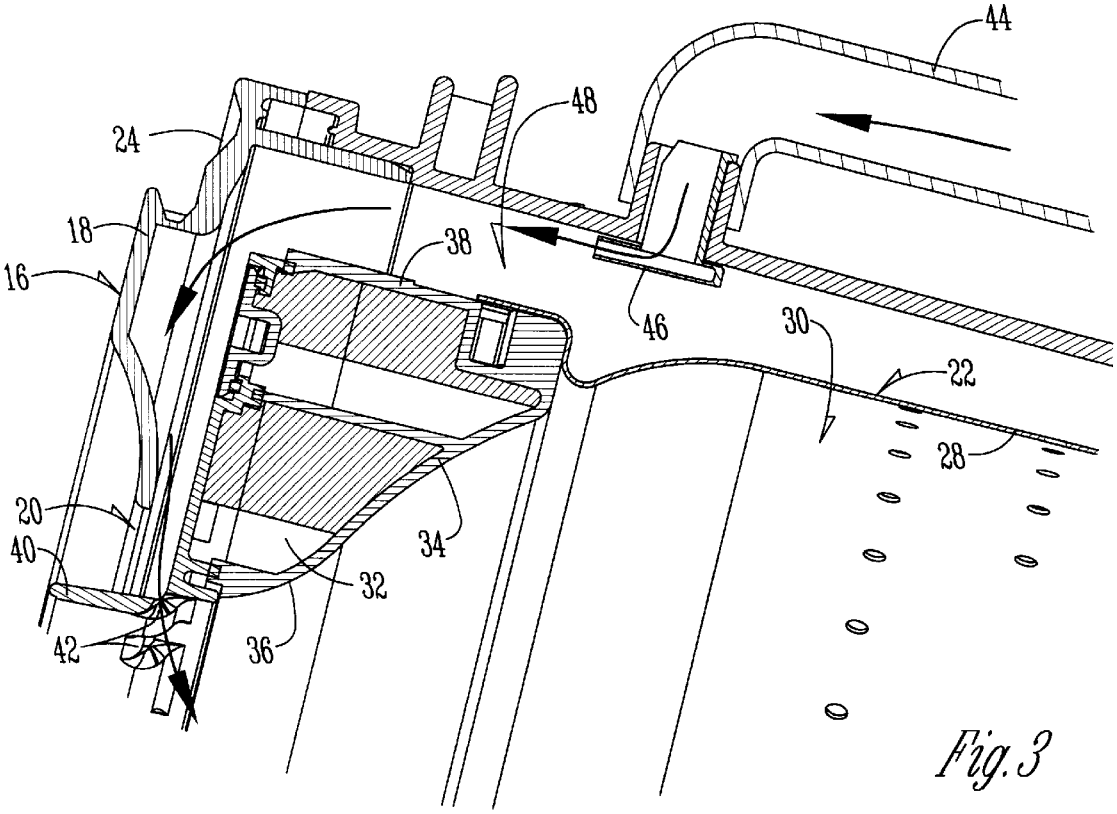
FIG. 3 is an enlarged sectional view taken along lines 3—3 of FIG. 2.
Figure 2:
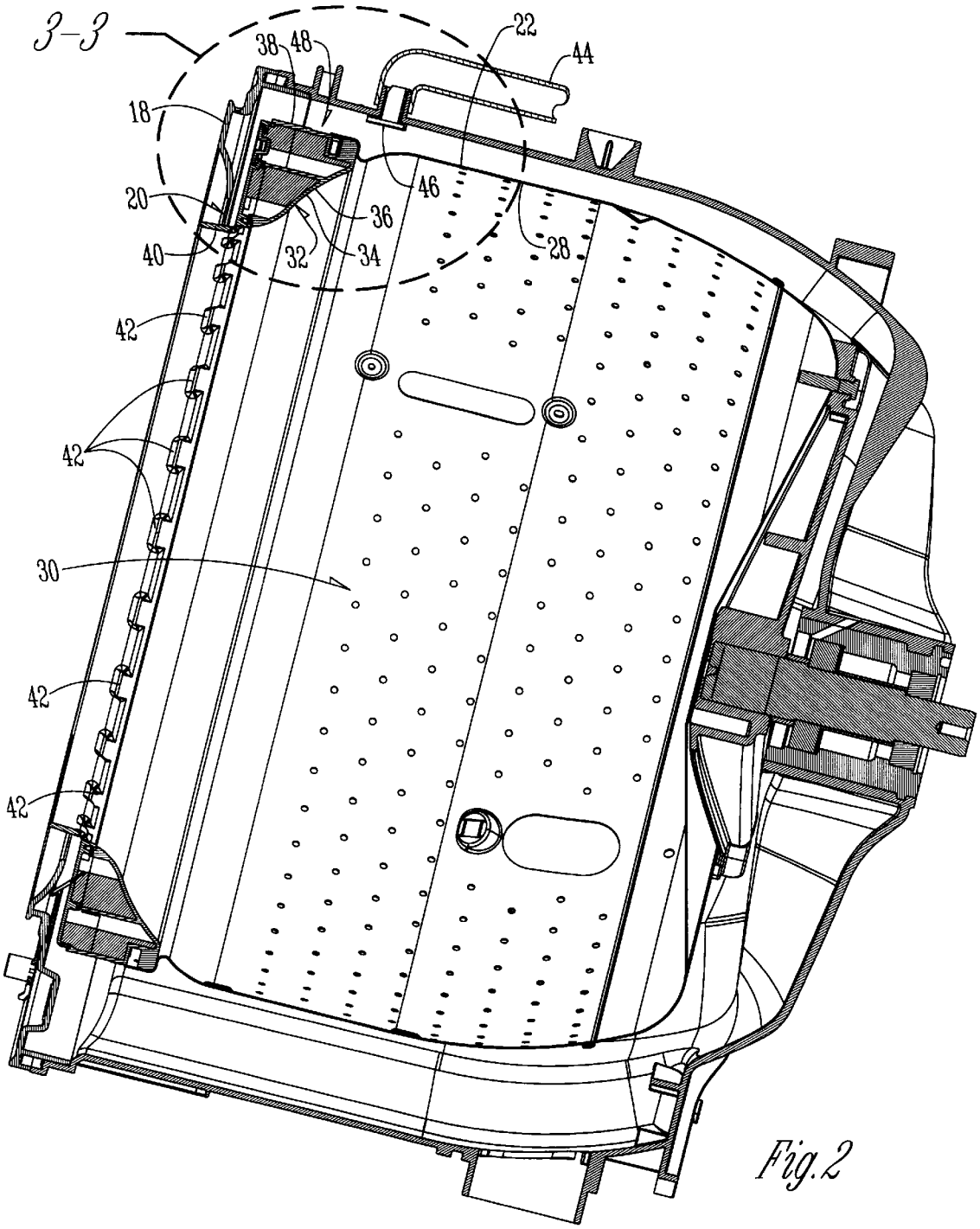
FIG. 2 is a sectional view showing the tub and spinner in a front loading washing machine.
Figure 4:
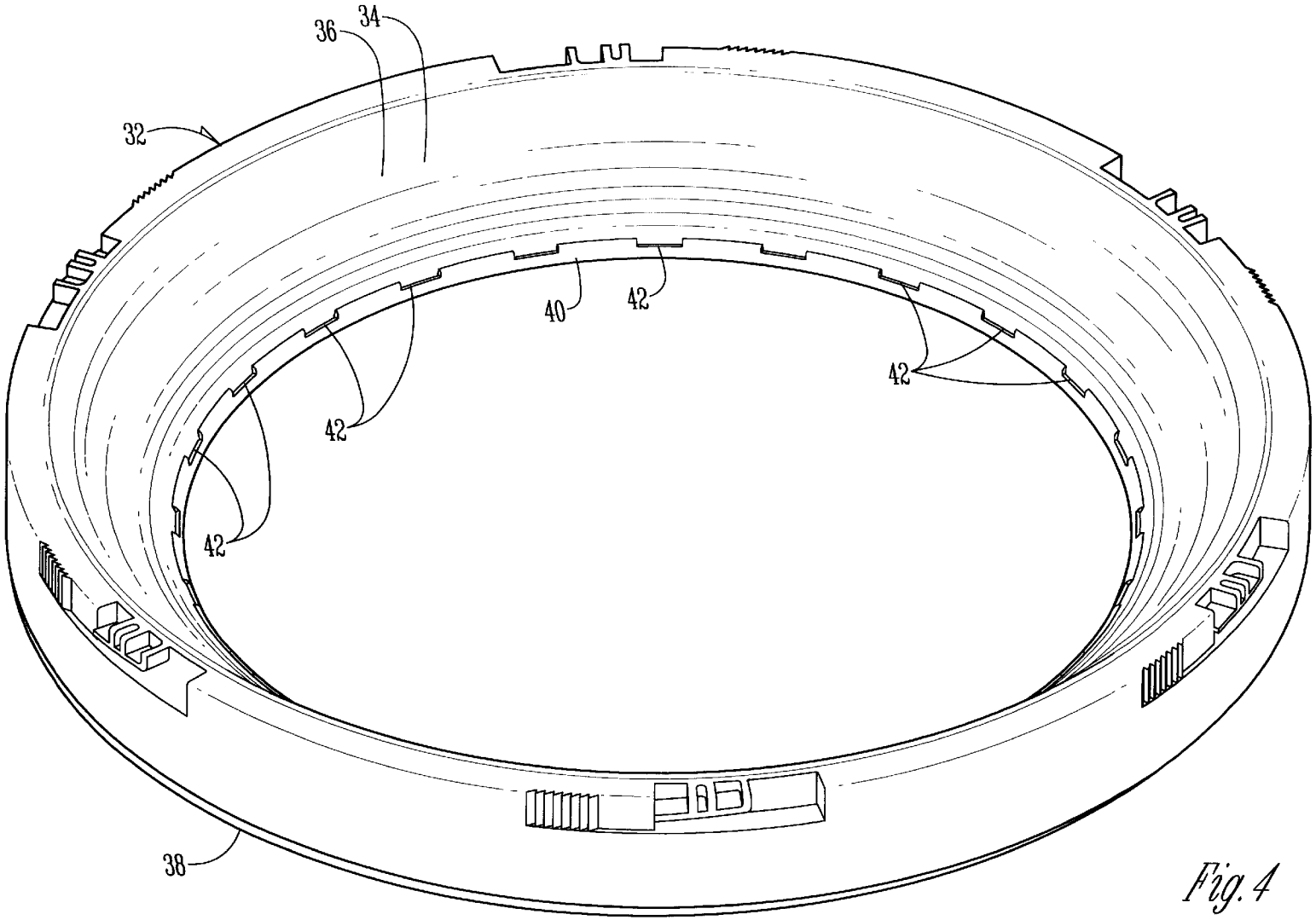
FIG. 4 is a rear perspective view of the balance ring with water supply holes therein.

A water supply line 44 terminates in an injector 46 located in the space 48 between the tub 16 and the spinner 22, as best seen in FIG. 3. The injector is located at a 12 o'clock position relative to the spinner 22. The injector 46 supplies water into the space 48 such that the water will flow by gravity and momentum along the outer surface 38 of the spinner 22, and then drain through some of the holes 42 into the chamber 30, thereby wetting clothes within the chamber 30.

There is no need for a pump or other pressure generator for the water being dripped through the balance ring 32.

It is understood that preferably, the water supply line 48 is a secondary line which supplies only a relatively small portion of the wash water into the tub 16. Conventional structure is utilized for supplying the majority of the wash water to the tub.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. An improved front loading washing machine including a cabinet, a tub mounted within the cabinet for holding water, a spinner rotatably mounted in the tub, the tub and spinner each having a forward end with an access opening therein through which clothes are moved into and from the spinner, and a balance ring extending around the access opening of the spinner, the improvement comprising:

the balance ring having a plurality of holes through which water can flow;

a water supply line terminating between the tub and spinner to allow water to flow along the balance ring and through the holes in the balance ring for wetting clothes in the spinner.

2. The improved washing machine of claim 1 wherein the holes in the balance ring extend substantially 360°.

3. The improved washing machine of claim 1 wherein the balance ring includes a main body with compartments for holding balancing fluid, and a lip forwardly extending from the body and into the access opening of the tub, the holes being located adjacent a juncture between the main body and lip.

4. The improved washing machine of claim 1 wherein the water supply line terminates at a 12 o'clock position relative to the spinner.

5. A method of wetting clothes in a front loading washing machine, the machine including a cabinet, a tub mounted within the cabinet for holding water, a spinner rotatably mounted in the tub, the tub and spinner each having a forward end with an access opening therein through which clothes are moved into and from the spinner, and a ring extending around the access opening of the spinner, the improvement comprising:

supplying water to an area between the tub and the spinner; and draining the water through holes in the ring for introduction into the spinner so as to wet clothes in the spinner.

6. The method of claim 5 wherein the water drains through the ring holes by gravity flow.

7. The method of claim 5 wherein the water is supplied at a 12 o'clock position relative to the spinner.

8. A method of wetting clothes in a front loading washing machine, the machine including a rotatable spinner with a substantially open forward end, a closed rearward end and a sidewall defining a chamber for holding clothes, and a balance ring mounted on the spinner adjacent the forward end, the balance ring having an inner surface disposed toward the spinner chamber and an outer surface disposed away from the spinner chamber, the method comprising:

supplying water for flow along the outer surface of the balance ring; and draining the water through holes in the balance ring for introduction into the spinner chamber.

9. The method of claim 8 wherein the machine further includes a tub surrounding the spinner in spaced relation, the method further comprising supplying the water to the space between the tub and spinner for flow along the outer surface of the balance ring.

10. The method of claim 8 wherein the water is supplied at a 12 o'clock position relative to the spinner.

* * * * *